US009728086B2

(12) United States Patent
Pruzanski et al.

(10) Patent No.: US 9,728,086 B2
(45) Date of Patent: Aug. 8, 2017

(54) SYSTEM AND METHOD FOR PROVIDING BUMPER ALERTS

(71) Applicants: Yossy Pruzanski, Ramat Gan (IL); Arie Heiman, Sde Warburg (IL)

(72) Inventors: Yossy Pruzanski, Ramat Gan (IL); Arie Heiman, Sde Warburg (IL)

(73) Assignee: CVIA Ltd., Sde Warburg (IL)

( * ) Notice: Subject to any disclaimer, the term of this patent is extended or adjusted under 35 U.S.C. 154(b) by 0 days.

(21) Appl. No.: 15/136,930

(22) Filed: Apr. 24, 2016

(65) Prior Publication Data

US 2016/0321922 A1 Nov. 3, 2016

Related U.S. Application Data

(60) Provisional application No. 62/155,490, filed on May 1, 2015.

(51) Int. Cl.

| | |
|---|---|
| ***G08G 1/0967*** | (2006.01) |
| ***G08G 1/01*** | (2006.01) |
| ***G08G 1/16*** | (2006.01) |
| *E01F 9/529* | (2016.01) |

(52) U.S. Cl.
CPC ..... *G08G 1/0967* (2013.01); *G08G 1/165* (2013.01); *E01F 9/529* (2016.02)

(58) Field of Classification Search
CPC ..... G08G 1/0967; E01F 9/50; E01F 9/529; G01C 21/3697; G01C 1/165
USPC ..... 701/532, 409
See application file for complete search history.

(56) References Cited

U.S. PATENT DOCUMENTS

| | | | | |
|---|---|---|---|---|
| 8,589,063 | B2 * | 11/2013 | Trum | G01C 21/3476 701/400 |
| 9,134,426 | B1 * | 9/2015 | Siris | G01S 19/07 |
| 2007/0118326 | A1 * | 5/2007 | Starodubtsev | G01P 15/08 702/141 |
| 2008/0015743 | A1 * | 1/2008 | Haug | B60T 7/22 701/1 |
| 2010/0057336 | A1 * | 3/2010 | Levine | G01C 21/32 701/532 |
| 2011/0224901 | A1 * | 9/2011 | Aben | G01C 21/32 701/532 |
| 2012/0053805 | A1 * | 3/2012 | Dantu | B60W 40/09 701/70 |
| 2013/0124082 | A1 * | 5/2013 | Cho | G01C 21/3638 701/409 |

(Continued)

OTHER PUBLICATIONS

Orlando et al., Car with MacPherson and Multilink suspension, 2012, multibody.net, http://www.multibody.net/teaching/msms/students-projects-2012/car-macpherson-multilink/.*

*Primary Examiner* — Thomas G Black
*Assistant Examiner* — Sara Lewandroski
(74) *Attorney, Agent, or Firm* — Reches Patents

(57) ABSTRACT

A method for providing a bumper alert, the method includes generating or receiving information about a location of a vehicle; generating or receiving information about a location of a bumper; and generating, by a computerized device, the bumper alert before the vehicle drives over the bumper; wherein the computerized device is at least partially located within the vehicle when generating the bumper alert; and wherein the generating of the bumper alert is based on a relationship between the location of the vehicle and the location of the bumper.

20 Claims, 8 Drawing Sheets

Flowchart

(56) References Cited

U.S. PATENT DOCUMENTS

| | | | | |
|---|---|---|---|---|
| 2013/0154854 | A1* | 6/2013 | Chen | G08G 1/096741 340/905 |
| 2015/0338221 | A1* | 11/2015 | Siris | G01C 21/32 701/409 |
| 2016/0009276 | A1* | 1/2016 | Moeller | B60W 30/09 701/41 |
| 2016/0201277 | A1* | 7/2016 | Svantesson | E01C 23/01 73/146 |
| 2016/0225259 | A1* | 8/2016 | Harris | G08G 1/0967 |

* cited by examiner

Zoom of typical post processing accelerometer signal at bumper event

Fig 5 Flowchart

SYSTEM AND METHOD FOR PROVIDING BUMPER ALERTS

BACKGROUND OF THE INVENTION

This application claims the priority of U.S. provisional patent Ser. No. 62/155,490 filing date May 1, 2015 which is incorporated herein by reference.

FIELD OF THE INVENTION

A System and Method that provides alert to the driver when approaching Bumpers in the Road as well as estimate the Quality of the road.

BACKGROUND

In order to reduce the speed of cars that are driving on roads in urban areas, the transportation authority of the city installs bumpers on the road also known as speed bumps to reduce the car speed that are crossing the road. This technique can be very effective, however in cases where the driver do not notice that he is approaching a bumper, than when the car impacts the bumper suddenly, the car jumps and the whole car vibrates which is dangerous and an unpleasant situation. It is well known that if this jump is done frequently or repetitively it can damage the user's body, the body of the car as well as the surrounding road near the bumper.

The locations of the bumpers are not documented in standard maps. Hence there is no way to warn automatically the driver in advance that he is approaching a bumper.

Most of the roads degrade with time, especially in winter time due to rain and snow roads become bad, driver would like to know it in advance. This dynamic information on the road condition is not available in standard maps. Namely there is no real time indication on the quality of the road such as: is the road well maintained?, does the road consist of many holes?, does the road covered by heavy snow?, does the road consist of plenty of bumpers, etc.

Another disadvantage of the bumper is especially at night where the car light bulbs are turned on. Hence at night when a car is passing a bumper the direction of the light changes and can temporary blind the drivers of cars that are coming toward his car, which can be very dangerous.

SUMMARY

According to an embodiment of the invention there may be provided a method for providing a bumper alert, the method may include generating or receiving information about a location of a vehicle; generating or receiving information about a location of a bumper; and generating, by a computerized device, the bumper alert before the vehicle drives over the bumper; wherein the computerized device may be at least partially located within the vehicle when generating the bumper alert; and wherein the generating of the bumper alert may be based on a relationship between the location of the vehicle and the location of the bumper.

The generating or receiving of the information about the location of the bumper may include receiving information about bumpers that may be within a predetermined range from the vehicle.

The method may include generating or receiving information about a speed of the vehicle; wherein the generating of the bumper alert may be based on a relationship between the location of the vehicle, the speed of the vehicle and the location of the bumper The method may include calculating a distance between the vehicle and the bumper; comparing the distance to a distance threshold that has a value that may be responsive to the speed of the vehicle; and generating the bumper alert when the distance may be lower than the distance threshold.

The method may include calculating a distance between the vehicle and the bumper; comparing the distance to a distance threshold that has a value that may be not responsive to the speed of the vehicle; and generating the bumper alert when the distance may be lower than the distance threshold.

The method may include monitoring vibrations of the vehicle by a sensor; and detecting, based on detection signals from the sensor, a passage of the vehicle over one or more bumpers.

The detecting of the passage of the vehicle over each one of the one or more bumpers may include searching for three peaks in the detection signals that (a) may be within a predefined distance from each other and (b) have a predefined peak to peak ratio.

The detecting of the passage of the vehicle over each bumper of the one or more bumpers may include calculating a bumper detection reliability value indicative of a reliability of the detection of the passage of the vehicle over the bumper.

The detecting of the passage of the vehicle over each bumper of the one or more bumpers may include calculating correlation the detection signals and shapes of reference bumpers that may be normalized to the speed of the vehicle.

The method may include monitoring vibrations of the vehicle by a sensor; and transmitting information about the vibrations to another computerized device thereby facilitating a detection of the passage of the vehicle over one or more bumpers.

The method may include monitoring vibrations of the vehicle by a sensor to provide detection signals; and detecting a passage of the vehicle over one or more bumpers by searching for one or more bumper signatures in the detection signals.

The method may include monitoring vibrations of the vehicle while the vehicle passes over a road segment; wherein the monitoring may be executed by a sensor and provides detection signals; and processing the detection signals to determine a quality of the road segment.

The processing of the detection signals may include calculating a variance of absolute values of detection signals obtained while the vehicle passes over the road segment; and comparing the variance to a variance threshold.

The processing of the detection signals may include finding, based on the detection signals, a number of bumpers included in the road segment; and comparing the number of bumpers to one or more bumpers thresholds determine the quality of the road segment.

The method may include receiving by the computerized device a request to generate the bumper alert; and generating, by the computerized device, the bumper alert.

The receiving of the request may be preceded by sending by the computerized device to another computerized device the information about the vibrations.

The method may include determining, by the computerized vehicle, to generate the bumper alert based on the relationship between the location of the vehicle, the speed of the vehicle and the location of the bumper.

According to an embodiment of the invention there may be provided a non-transitory computer readable medium that stores instructions for generating or receiving information about a location of a vehicle; generating or receiving information about a location of a bumper; and generating, by a computerized device, the bumper alert before the vehicle drives over the bumper; wherein the generating of the bumper alert may be responsive to a relationship between the location of the vehicle and the location of the bumper; and wherein the computerized device may be at least partially located within the vehicle when generating the bumper alert.

The non-transitory computer readable medium may store instructions for executing any step of any method mentioned in the specification and/or the claims.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

DETAILED DESCRIPTION OF THE DRAWINGS

Figure 1:
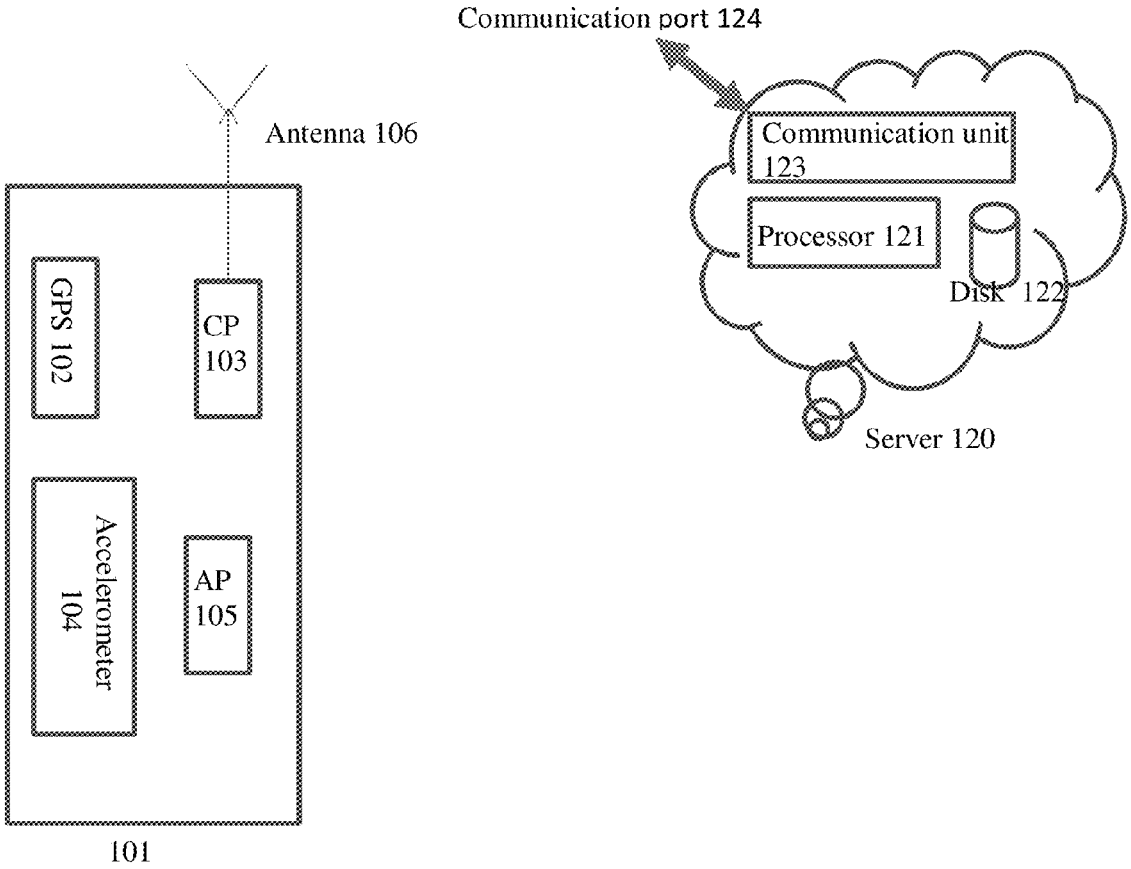
FIG. 1 illustrates a system according to an embodiment of the invention.

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

Because the illustrated embodiments of the present invention may for the most part, be implemented using electronic components and circuits known to those skilled in the art, details will not be explained in any greater extent than that considered necessary as illustrated above, for the understanding and appreciation of the underlying concepts of the present invention and in order not to obfuscate or distract from the teachings of the present invention.

Any reference in the specification to a method should be applied mutatis mutandis to a system capable of executing the method and should be applied mutatis mutandis to a non-transitory computer readable medium that stores instructions that once executed by a computer result in the execution of the method.

Any reference in the specification to a system should be applied mutatis mutandis to a method that may be executed by the system and should be applied mutatis mutandis to a non-transitory computer readable medium that stores instructions that may be executed by the system.

Any reference in the specification to a non-transitory computer readable medium should be applied mutatis mutandis to a system capable of executing the instructions stored in the non-transitory computer readable medium and should be applied mutatis mutandis to method that may be executed by a computer that reads the instructions stored in the non-transitory computer readable medium.

There is provided a system and method that can warn automatically the driver in advance that he is approaching a bumper or a bad road. In our system the bumpers or road condition is updated in real time and provided to the car driver alert on it. Alternatively this information can be embedded in the user's navigation system like Waze of Google Inc. in order to enable the system to choose an optimized trip that bypasses these roads when planning the path from point A to point B.

Our system may include two major components. These components may be hardware components or software components. In the latter case the server and the device within the car may include non-transitory computer readable medium for storing the software.

One component embedded in a mobile phone or any other device that is used in the car and a second component that resides in a remote computerized system such as a server which collects from all the cars that pass the bumper various information including its location, its height and other relevant parameters. This data are stored in the server database. All the data are processed in the server for further use as will be described later in details.

The server will share the bumper location information and the road condition with the relevant cars, by either sending to the car a map or list of all the bumpers that are near to his current location.

The device in the car identify its location information as an example from its GPS, and combine it with the bumper location map or the road condition that was sent by the server, to decide if the car is approaching a known bumper. If the car approaches a bumper, the system will alert the driver in advance. This will allow the driver to slow down before passing the bumper.

FIG. 1 illustrates a system according to an embodiment of the invention.

One subsystem of the system is embedded in a mobile phone 101 or any other device that is used in the car and a second subsystem 120 that resides in a server which collects from all the cars that pass the bumper various information including its location, its height and other relevant parameters. Let's describe first subsystem embedded in the mobile device 101. It consist of a built-in accelerometer 104 or other similar sensors, Global Position System (GPS) component 102 and application processor (AP) 105 that can via communication processor (CP) 103 and antenna 106 communicate at least with one server, and can send or receive relevant digital information from or to the server. These capabilities is common in most of the smart phone that are today in the market, typical phone can be Galaxy S3, Galaxy S4, Galaxy S5, IPhone 4, 5 etc.

The application processor 105 runs an application that has three main functions: Warning the car driver that the car is of approaching a known bumper. Bumper detection process of known and unknown bumpers. Road condition decision The warning process that the car is approaching a known bumper is as follows; the device 101 in the car knows his location that is based on the info from the GPS 102. This location of the car is sent periodically to the server 120. Based on his location the sever send to the device 101 a list or a map of bumpers that are located near his location. (or warning indication from the server that his car is approaching a bumper). Based on the car location and the list of bumpers, the AP 105 calculates the distance between the nearest bumper location and the car location. If the distance is below a threshold Th-Distance, the car driver gets an indication (visually or by sound indication) that the car approaching a bumper. The Th-Distance depends on the car speed, as the car is driving faster the indication will be earlier in order that the driver will be able to respond to the warning. The car speed can be estimated from sampling the GPS coordination.

Bumper detection process of known and unknown bumpers

Figure 2:
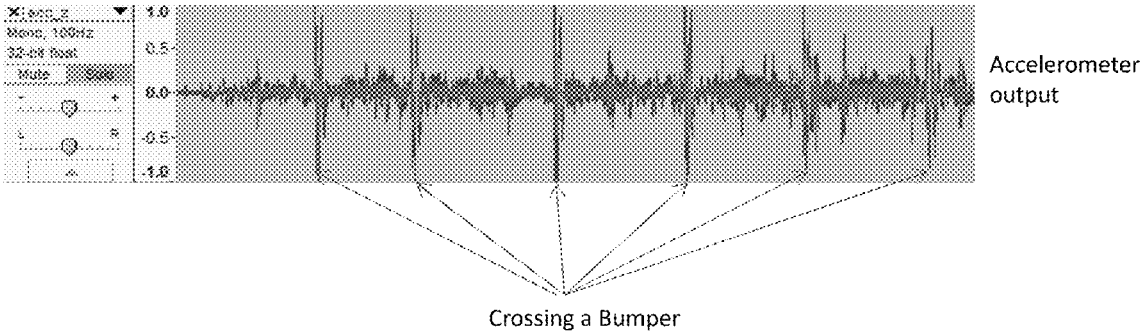
FIG. 2 illustrates output signals of an accelerometer located within a car, the output signals represent the passage of the car over a bumper.

Once the car pass a bumper at least one of the accelerometer axis in the mobile phone will sense that he is passing a bumper, typical accelerometer signal will be such as depicted in FIG. 2. FIG. 2 presents the output of the accelerometer while passing through sequence of bumpers. The picks in the accelerometer signal provides sufficient data to detect the passing of bumper. The output of the accelerometer signal can be captured in various sampling rate, a typical sampling rate of 100 hz output can be seen in FIG. 2. It must be noted that the accelerated axes depend on the orientation of the device in the car. In our example the application chose the axes with the biggest variation, alternatively all the three axes can be analyzed simultaneously.

Figure 3:
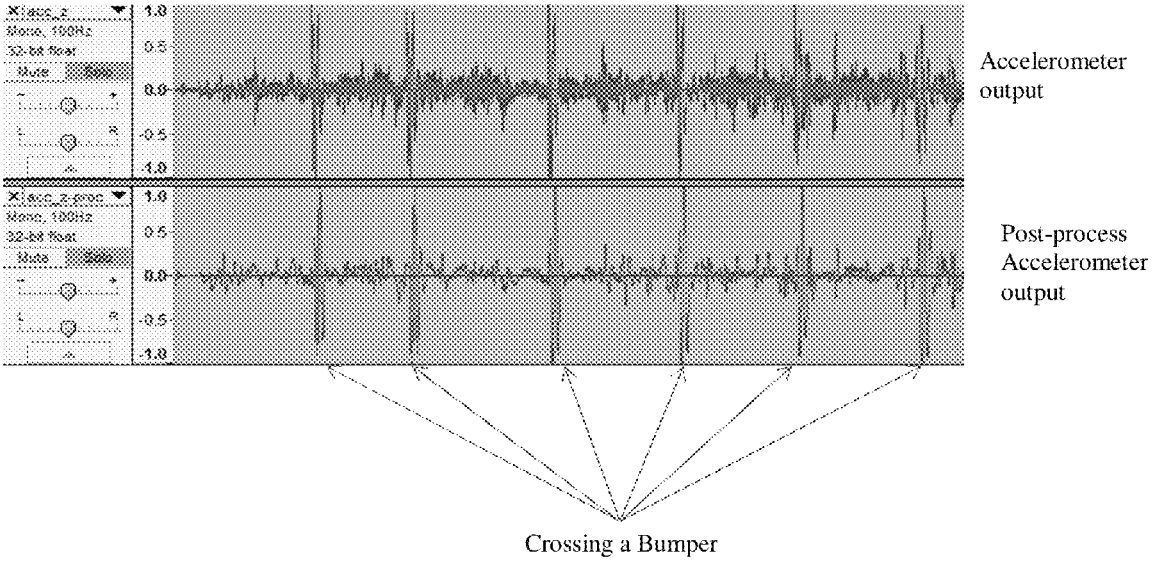
FIG. 3 illustrates output signals of an accelerometer and processed output signals of an accelerometer according to an embodiment of the invention.

The Accelerometer can be further processed as an example by filtering it with a narrow band filter, a typical output is presented in FIG. 3.

Figure 4:
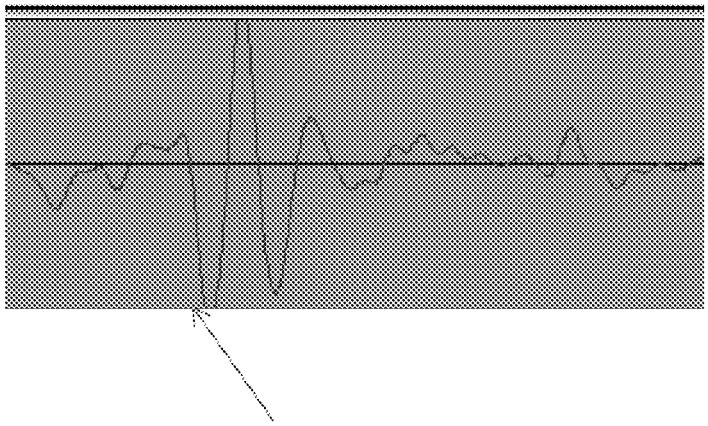
FIG. 4 illustrates processed output signals of an accelerometer according to an embodiment of the invention.
Figure 5:
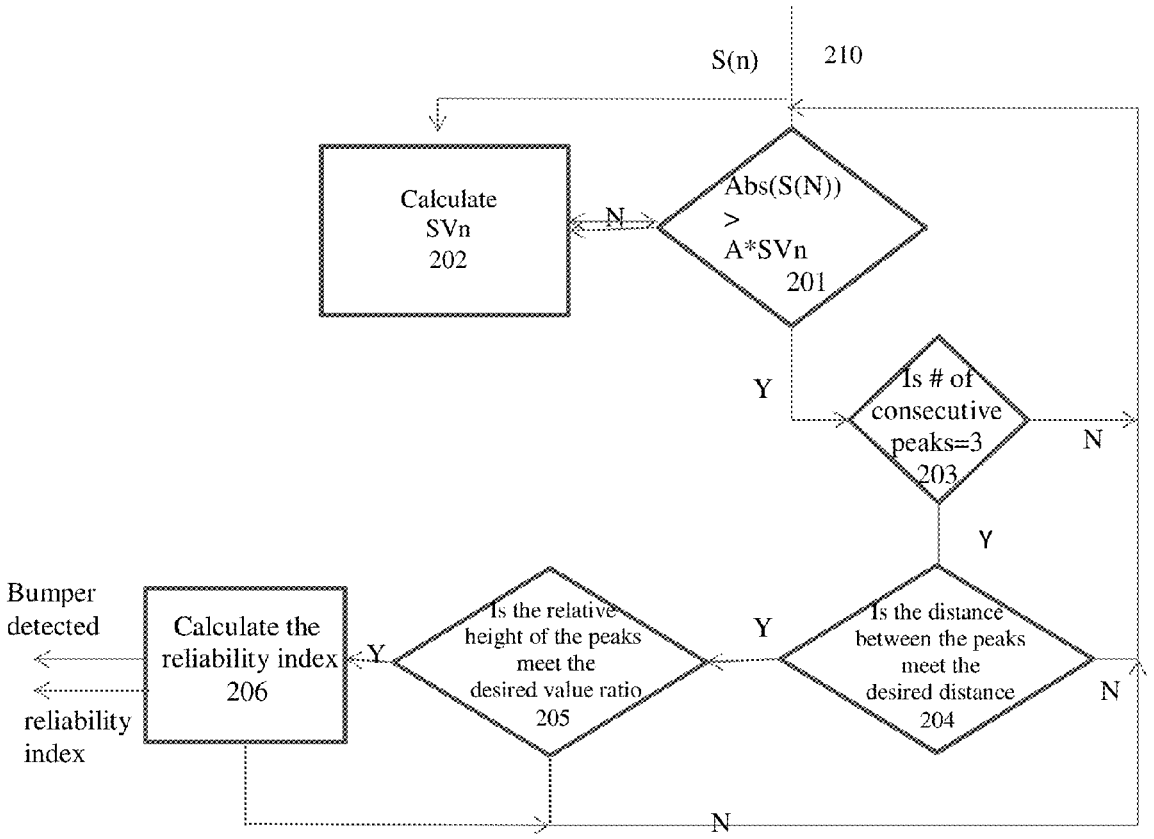
FIG. 5 illustrates a method according to an embodiment of the invention.

If we zoom in, in a specific event of passing a bumper, we can see typical waveform as presented in FIG. 4. In order to decide if the car pass a bumper the algorithm that runs in the AP 105 analyze the signal and extract various features; As an example it calculate, the number of consecutive peaks, the size of the peaks relative to the non-peak average, the distance between the peaks. Etc. This analysis is done as an example on 10 ms sliding window. Once all the features meet the desired thresholds the system declares that a bumper was detected. In addition the algorithm calculates a reliability index between 0-1. Zero means non reliable decision, 1 means very reliable decision. A typical flowchart of the decision process is presented in FIG. 5. Any number less than 1 means smaller reliability of the decision. Once the Bumper is detected the location information together with the reliability index is sent to the server via 106. One can use a different approach by using normalized autocorrelation technique between the accelerometer signal and pre-stored shapes of bumpers which is normalized to the car speed. For simplicity, only one approach is presented in this document. Referring to FIG. 5, FIG. 5 is a typical block diagram that presents the bumper detection process. The accelerometer signal S(n) is fed to block 202 and 201. In this block the sliding variance SV(n) of the non-peak area is calculated. Bloc 201 indicated to block 202 when a peak is detected. The window that is used can be as an example few seconds. In 201 the absolute value of S(n) is calculated and is compare to SVn, if its value is greater than A times SV, peak is declared. Typical value of A can be as an example equal to 3. As can be seen from FIG. 4 typical bumper consist of 1 deep followed by one peak and by one deep. Namely Abs(S(n)) have 3 consecutive peaks. Block 203 test if 3 consecutive peaks was detected, if not, it continues to search for the next peak. If three consecutive peaks were detected, the distances between the peaks are calculated. The distance between the peaks are compared to the distance of a typical bumper. If it meets the typical distance condition of Bumper, it continues to 205. If no, the system continues to 210 to detect the next peak for finding the next sliding 3 peaks. Another criterion to decide if we pass a bumper is to check in 205 the relative height of the 3 peaks. If it meets the desired ratio we declare the bumper is detected and its reliability index is calculated in 206 by using its average peak level. The decision of a bumper, its coordinates with its reliability index is sent to the server for further use. The loop continues to find the next bumper.

Figure 6:
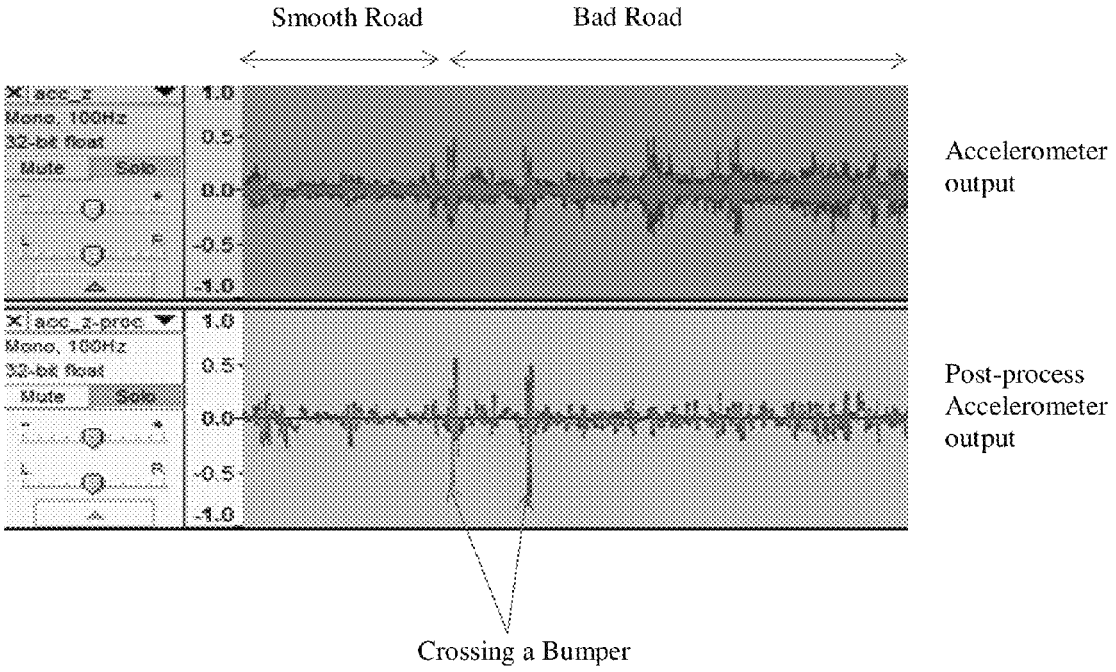
FIG. 6 illustrates output signals of an accelerometer and processed output signals of an accelerometer according to an embodiment of the invention.

In FIG. 6 we can see two typical roads smooth road area and bad road area where in the beginning of the bad road area two bumpers exist. As expected in the bad road area the variation of the accelerometer signal is significantly higher than in the smooth road.

In the smooth road part the variation of the accelerometer is small which indicate that the car is not vibrating too much during the drive, namely the road is smooth. In the bad road segment, the variance of the road is high due to the road condition, which means that the vibration of the car is high.

The sliding variance Vn of the accelerometer signal is calculated by using a typical window size of few minutes. Based on the variance value one can decide if the car is passing a smooth road or bad road. Block diagram in FIG. 7 presents the flowchart of this decision.

Figure 7:
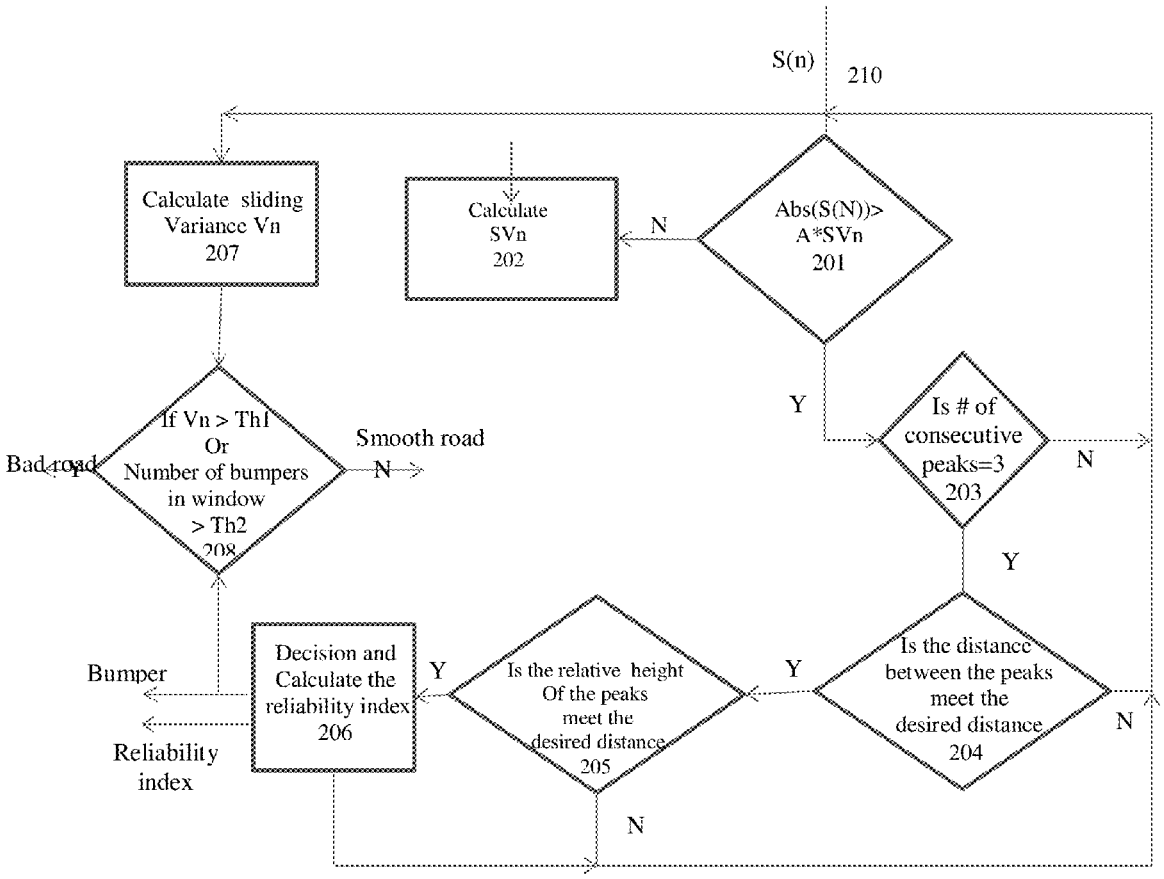
FIG. 7 illustrates a method according to an embodiment of the invention.

Referring to FIG. 7 it is the same as in FIG. 6 but two new blocks 207 and 208 are added. In Block 207 the variance of S(n) is calculated during a window of few minutes its value we note as Vn. At 208 this value is compared to a threshold Th1. If the variance is bigger than the threshold TH1 we declare that the road is bad. In addition if the number of the bumpers is greater than Th2 it means that this road has plenty of bumpers and it is declared as a bad road segment. The indication if bumper was detected or not is from 206.

Figure 8:
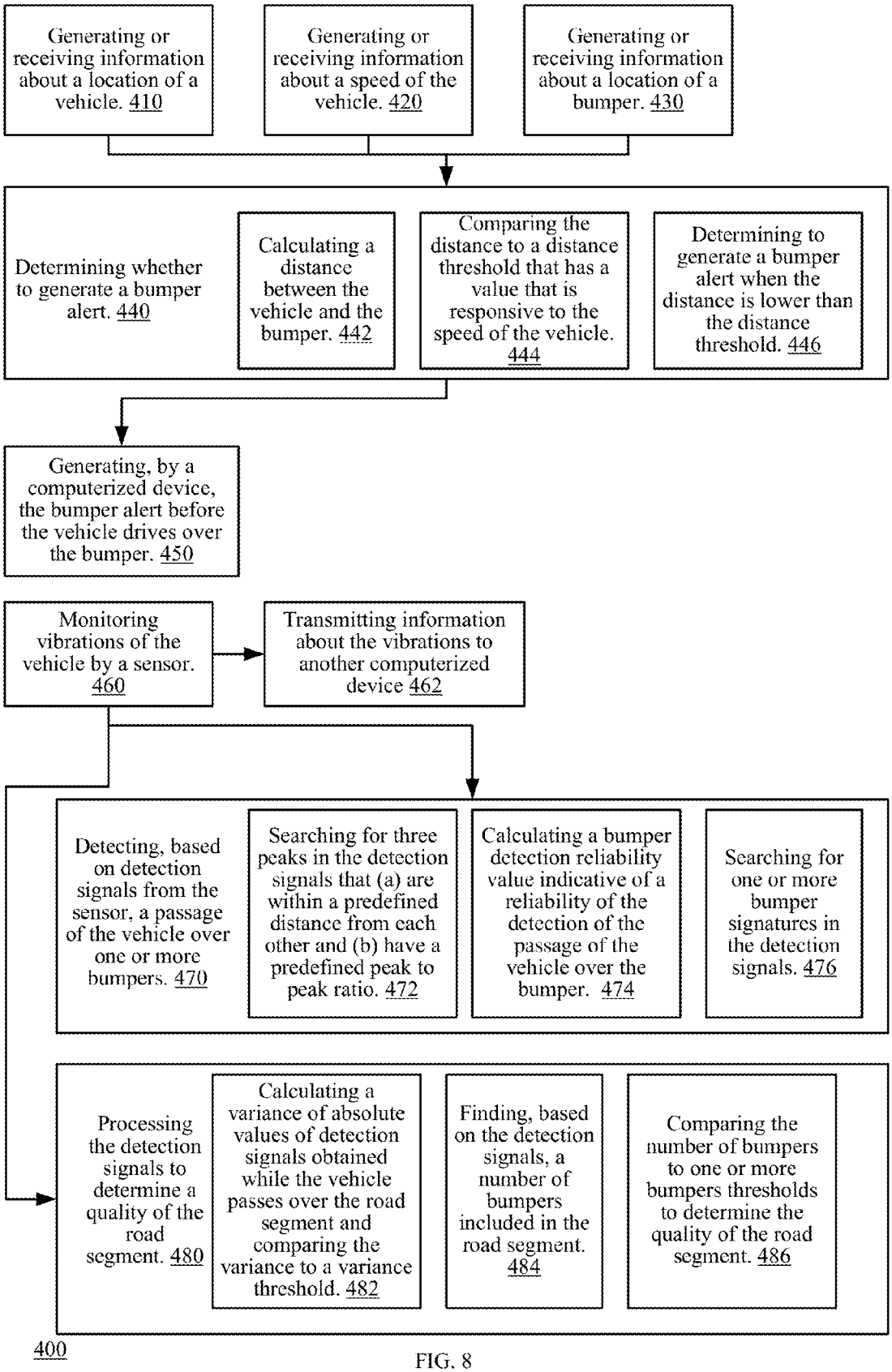
FIG. 8 illustrates a method according to an embodiment of the invention.

FIG. 8 illustrates method 400 according to an embodiment of the invention.

Method 400 may be executed by device 101 and/or by server 120. One or more steps of method 400 may be executed by device 101 while one or other steps of method 400 may be executed by server 120.

It is noted that device 101 and server are merely two non-limiting examples of computerized devices that may participate in the execution of method 400. For example, server 120 may be multiple computers, may be replaced by one or more computer that is not a server, and the like. Yet for example, device 101 may be a mobile phone, a laptop computer, a computer that is installed in the vehicle, a vehicle computer, and the like.

Method 400 may start by steps 410, 420 and 430.

Step 410 may include generating or receiving information about a location of a vehicle. The information about the location of the vehicle may be provided from a computerized device (such as device 101) that are located (at least temporarily) within the vehicle and/or from computerized devices that are located outside the vehicle (such as cellular network location devices, cameras and/or other sensor based devices).

Step 420 may include generating or receiving information about a speed of the vehicle.

The information about the speed of the vehicle may be driven from the information about the location of the vehicle—changes in the location over time (and in this case step 420 may follow step 410) but may be obtained regardless of the location of the vehicle (for example by obtaining speed information from a speedometer). Step 420 may be optional.

Step 430 may include generating or receiving information about a location of a bumper.

The information may include a map of bumpers (or any other representation of locations of the bumpers) that are within the vicinity of the vehicle.

The vicinity of the vehicle may be defined by a predefined range from the vehicle. The vicinity may include a region that is few meters long, tens of meters long, hundreds of meters long, few kilometers long, and the like. The size of the region may differ from urban regions and/or bumper rich regions to rural regions and/or non-bumper rich regions.

Steps 410, 420 and 430 are followed by step 440 of determining whether to generate a bumper alert.

Step 440 may include calculating a distance between the vehicle and the bumper; comparing the distance to a distance threshold. The value of the distance threshold may or may not be responsive to the speed of the vehicle; and generating the bumper alert when the distance is lower than the distance threshold.

When determining to generate the bumper alert step 440 is followed by step 450 of generating, by a computerized device, the bumper alert before the vehicle drives over the bumper.

The computerized device may be at least partially located within the vehicle during step 450.

The bumper alert may be an audio bumper alert and/or a visual bumper alert. The bumper alert is generated so as to be noticed by a driver of the vehicle (or one or other persons within the vehicle).

A visual bumper alert should be provided within an actual or expected field of view of the driver. For example, the visual bumper alert may be displayed within a display of a mobile phone of the driver. Yet for another example, the visual bumper alert may be produced by a multimedia system of the vehicle and/or by a dedicated display.

Method 400 may include step 460 of monitoring vibrations of the vehicle by a sensor. A non-limiting example of a sensor may be accelerometer 104 of FIG. 1.

Step 460 may be followed by step 462 of transmitting information about the vibrations to another computerized device (such as server 120) thereby facilitating a detection of the passage of the vehicle over one or more bumpers—by the other computerized device. The transmitting may include using any wired and/or wireless connections.

Step 460 may be followed by step 470 of detecting, based on detection signals from the sensor, a passage of the vehicle over one or more bumpers. See, for example, FIGS. 5 and 7.

The detection (step 470) may be executed by any computerized device—for example by server 120 and/or by device 101.

Step 470 may include searching (472) for three peaks in the detection signals that (a) are within a predefined distance from each other and (b) have a predefined peak to peak ratio (ratio between the values of the peaks).

Step 470 may include calculating (474) a bumper detection reliability value indicative of a reliability of the detection of the passage of the vehicle over the bumper. See, for example, step 206 of FIGS. 5 and 7.

Step 470 may include searching (476) for one or more bumper signatures in the detection signals.

The vehicle may drive over multiple road segments. A road segment if a part of a road of a certain length. Different road segments may be of equal length although some road segments may differ from each other by length. A road segment may be few meters till many kilometers long.

When step 460 includes monitoring the detection signals obtained while the vehicle passes over a road segment then step 460 may be followed by step 480 of processing the detection signals to determine a quality of the road segment.

The road quality may be a binary variable or a non-binary variable.

Step 480 may include step 482 of calculating a variance of absolute values of detection signals obtained while the vehicle passes over the road segment and comparing the variance to a variance threshold.

Step 480 may include finding, based on the detection signals, a number of bumpers included in the road segment; and comparing the number of bumpers to one or more bumpers thresholds to determine the quality of the road segment.

The invention may also be implemented in a computer program for running on a computer system, at least including code portions for performing steps of a method according to the invention when run on a programmable apparatus, such as a computer system or enabling a programmable apparatus to perform functions of a device or system according to the invention. The computer program may cause the storage system to allocate disk drives to disk drive groups.

A computer program is a list of instructions such as a particular application program and/or an operating system. The computer program may for instance include one or more of: a subroutine, a function, a procedure, an object method, an object implementation, an executable application, an applet, a servlet, a source code, an object code, a shared library/dynamic load library and/or other sequence of instructions designed for execution on a computer system.

The computer program may be stored internally on a non-transitory computer readable medium. All or some of the computer program may be provided on computer readable media permanently, removably or remotely coupled to an information processing system. The computer readable media may include, for example and without limitation, any number of the following: magnetic storage media including disk and tape storage media; optical storage media such as compact disk media (e.g., CD-ROM, CD-R, etc.) and digital video disk storage media; nonvolatile memory storage media including semiconductor-based memory units such as FLASH memory, EEPROM, EPROM, ROM; ferromagnetic digital memories; MRAM; volatile storage media including registers, buffers or caches, main memory, RAM, etc.

A computer process typically includes an executing (running) program or portion of a program, current program values and state information, and the resources used by the operating system to manage the execution of the process. An operating system (OS) is the software that manages the sharing of the resources of a computer and provides programmers with an interface used to access those resources. An operating system processes system data and user input, and responds by allocating and managing tasks and internal system resources as a service to users and programs of the system.

The computer system may for instance include at least one processing unit, associated memory and a number of input/output (I/O) devices. When executing the computer program, the computer system processes information according to the computer program and produces resultant output information via I/O devices.

In the foregoing specification, the invention has been described with reference to specific examples of embodiments of the invention. It will, however, be evident that various modifications and changes may be made therein without departing from the broader spirit and scope of the invention as set forth in the appended claims.

Moreover, the terms "front," "back," "top," "bottom," "over," "under" and the like in the description and in the claims, if any, are used for descriptive purposes and not necessarily for describing permanent relative positions. It is understood that the terms so used are interchangeable under appropriate circumstances such that the embodiments of the invention described herein are, for example, capable of operation in other orientations than those illustrated or otherwise described herein.

Those skilled in the art will recognize that the boundaries between logic blocks are merely illustrative and that alternative embodiments may merge logic blocks or circuit elements or impose an alternate decomposition of functionality upon various logic blocks or circuit elements. Thus, it is to be understood that the architectures depicted herein are merely exemplary, and that in fact many other architectures may be implemented which achieve the same functionality.

Any arrangement of components to achieve the same functionality is effectively "associated" such that the desired functionality is achieved. Hence, any two components herein combined to achieve a particular functionality may be seen as "associated with" each other such that the desired functionality is achieved, irrespective of architectures or intermedial components. Likewise, any two components so associated can also be viewed as being "operably connected," or "operably coupled," to each other to achieve the desired functionality.

Furthermore, those skilled in the art will recognize that boundaries between the above described operations merely illustrative. The multiple operations may be combined into a single operation, a single operation may be distributed in additional operations and operations may be executed at least partially overlapping in time. Moreover, alternative embodiments may include multiple instances of a particular operation, and the order of operations may be altered in various other embodiments.

Also for example, in one embodiment, the illustrated examples may be implemented as circuitry located on a single integrated circuit or within a same device. Alternatively, the examples may be implemented as any number of separate integrated circuits or separate devices interconnected with each other in a suitable manner.

Also for example, the examples, or portions thereof, may implemented as soft or code representations of physical circuitry or of logical representations convertible into physical circuitry, such as in a hardware description language of any appropriate type.

Also, the invention is not limited to physical devices or units implemented in non-programmable hardware but can also be applied in programmable devices or units able to perform the desired device functions by operating in accordance with suitable program code, such as mainframes, minicomputers, servers, workstations, personal computers, notepads, personal digital assistants, electronic games, automotive and other embedded systems, cell phones and various other wireless devices, commonly denoted in this application as 'computer systems'.

However, other modifications, variations and alternatives are also possible. The specifications and drawings are, accordingly, to be regarded in an illustrative rather than in a restrictive sense.

In the claims, any reference signs placed between parentheses shall not be construed as limiting the claim. The word 'comprising' does not exclude the presence of other elements or steps then those listed in a claim. Furthermore, the terms "a" or "an," as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles. Unless stated otherwise, terms such as "first" and "second" are used to arbitrarily distinguish between the elements such terms describe. Thus, these terms are not necessarily intended to indicate temporal or other prioritization of such elements. The mere fact that certain measures are recited in mutually different claims does not indicate that a combination of these measures cannot be used to advantage.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

We claim:

1. A method for providing a bumper alert, the method comprises:

generating or receiving information about a location of a vehicle;

generating or receiving information about a location of a bumper;

generating, by a computerized device, the bumper alert before the vehicle drives over the bumper; wherein the computerized device is at least partially located within the vehicle when generating the bumper alert; and wherein the generating of the bumper alert is based on a relationship between the location of the vehicle and the location of the bumper;

monitoring vibrations of the vehicle by a sensor; and detecting, based on detection signals from the sensor, a passage of the vehicle over the bumper when finding three peaks in the detection signals that (a) are within a predefined distance from each other and (b) have a predefined peak to peak ratio;

wherein the detecting of the passage of the vehicle over each bumper of the one or more bumpers comprises at least one out of:

(i) comparing an absolute value of a detection signal to a sliding variance of a non-peak area; and (ii) calculating a bumper detection reliability value indicative of a reliability of the detection of the passage of the vehicle over the bumper by using an average peak level of the three peaks.

2. The method according to claim 1, wherein the generating or receiving of the information about the location of the bumper comprises receiving information about bumpers that are within a predetermined range from the vehicle.

3. The method according to claim 1, comprising generating or receiving information about a speed of the vehicle; wherein the generating of the bumper alert is based on a relationship between the location of the vehicle, the speed of the vehicle and the location of the bumper.

4. The method according to claim 3, comprising: calculating a distance between the vehicle and the bumper; comparing the distance to a distance threshold that has a value that is responsive to the speed of the vehicle; and generating the bumper alert when the distance is lower than the distance threshold.

5. The method according to claim 1, comprising: calculating a distance between the vehicle and the bumper; comparing the distance to a distance threshold that has a value that is not responsive to the speed of the vehicle; and generating the bumper alert when the distance is lower than the distance threshold.

6. The method according to claim 1 wherein the sensor is an accelerometer comprising three axes, and wherein the detection signals on the axis with the biggest variation of acceleration out of the three axes are selected.

7. The method according to claim 1 wherein the detecting of the passage of the vehicle over each bumper of the one or more bumpers comprises comparing the absolute value of the detection signal to the sliding variance of the non-peak area.

8. The method according to claim 1, wherein the detecting of the passage of the vehicle over each bumper of the one or more bumpers comprises calculating the bumper detection reliability value indicative of the reliability of the detection of the passage of the vehicle over the bumper by using the average peak level of the three peaks.

9. The method according to claim 1, wherein the detecting of the passage of the vehicle over each bumper of the one or more bumpers comprises calculating correlation the detection signals and shapes of reference bumpers that are normalized to the speed of the vehicle.

10. The method according to claim 1 comprising detecting a peak when the absolute value of the detection signal is at least three times bigger than the sliding variance of a non-peak area.

11. The method according to claim 1 wherein the three peaks comprise a first negative peak that is followed by a positive peak that is followed by a second negative peak.

12. The method according to claim 1, comprising: processing the detection signals to determine a quality of the road segment.

13. The method according to claim 12, wherein the processing of the detection signals comprises: calculating a variance of absolute values of detection signals obtained while the vehicle passes over the road segment; and comparing the variance to a variance threshold.

14. The method according to claim 12, wherein the processing of the detection signals comprises: finding, based on the detection signals, a number of bumpers included in the road segment; and comparing the number of bumpers to one or more bumpers thresholds determine the quality of the road segment.

15. A non-transitory computer readable medium that stores instructions for: generating or receiving information about a location of a vehicle;

generating or receiving information about a location of a bumper;

generating, by a computerized device, the bumper alert before the vehicle drives over the bumper; wherein the generating of the bumper alert is responsive to a relationship between the location of the vehicle and the location of the bumper; and wherein the computerized device is at least partially located within the vehicle when generating the bumper alert;

monitoring vibrations of the vehicle by a sensor; and detecting, based on detection signals from the sensor, a passage of the vehicle over the bumper when finding three peaks in the detection signals that (a) are within a predefined distance from each other and (b) have a predefined peak to peak ratio;

wherein the detecting of the passage of the vehicle over each bumper of the one or more bumpers comprises at least one out of:

(i) comparing an absolute value of a detection signal to a sliding variance of a non-peak area; and (ii) calculating a bumper detection reliability value indicative of a reliability of the detection of the passage of the vehicle over the bumper by using an average peak level of the three peaks.

16. The non-transitory computer readable medium according to claim 15 wherein the three peaks comprise a first negative peak that is followed by a positive peak that is followed by a second negative peak.

17. The non-transitory computer readable medium according to claim 15 that stores instructions for calculating the bumper detection reliability value indicative of the reliability of the detection of the passage of the vehicle over the bumper by using the average peak level of the three peaks.

18. The non-transitory computer readable medium according to claim 15 that stores instructions for detecting a peak when the absolute value of the detection signal is at least three times bigger than the sliding variance of a non-peak area.

19. The non-transitory computer readable medium according to claim 15 wherein the sensor is an accelerometer comprising three axes, and wherein the non-transitory computer readable medium stores instructions for selecting the detection signals on the axis with the biggest variation of acceleration out of the three axes.

20. The non-transitory computer readable medium according to claim 15 that stores instructions for detecting of the passage of the vehicle over each bumper of the one or more bumpers comprises comparing the absolute value of the detection signal to the sliding variance of the non-peak area.

* * * * *